US007827946B2

(12) United States Patent
Ishii et al.

(10) Patent No.: US 7,827,946 B2
(45) Date of Patent: Nov. 9, 2010

(54) ENGINE VALVE LIFTER MECHANISM OF INTERNAL COMBUSTION ENGINE

(75) Inventors: Shinichi Ishii, Atsugi (JP); Akira Hidaka, Novi, MI (US); Keisuke Takeda, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 423 days.

(21) Appl. No.: 11/979,225

(22) Filed: Oct. 31, 2007

(65) Prior Publication Data

US 2008/0115752 A1 May 22, 2008

(30) Foreign Application Priority Data

Nov. 22, 2006 (JP) ..... 2006-314953

(51) Int. Cl.
*F01L 1/34* (2006.01)

(52) U.S. Cl. ..... 123/90.16; 123/90.31; 123/90.44; 74/569

(58) Field of Classification Search ..... 123/90.16, 123/90.48, 90.52, 90.31, 90.39, 90.44; 74/559, 74/567, 569

See application file for complete search history.

(56) References Cited

U.S. PATENT DOCUMENTS 4,321,894 A * 3/1982 Black ..... 123/90.54
5,988,125 A * 11/1999 Hara et al. ..... 123/90.16
6,397,806 B2 * 6/2002 Imai et al. ..... 123/90.48
7,246,578 B2 7/2007 Nakamura et al.
2005/0284434 A1 12/2005 Tsuruta et al.
2006/0027200 A1 2/2006 Tsuruta et al.

FOREIGN PATENT DOCUMENTS

JP 2-26704 U 2/1990
JP 4-75108 U 6/1992
JP 8-42310 A 2/1996
JP 11-107725 4/1999
JP 2005-232974 A 9/2005
JP 2006-9080 A 1/2006
JP 2006-46123 A 2/2006
JP 2006-057637 3/2006
JP 2007-247449 A 9/2007

* cited by examiner

*Primary Examiner*—Ching Chang
(74) *Attorney, Agent, or Firm*—Foley & Lardner LLP

(57) ABSTRACT

An upper surface of a head part of a valve lifter has a predetermined turn back portion at which, with a variable valve control device kept controlled to induce a maximum lift of an engine valve, a swing stroke of a rounded cam surface of a swing cam relative to the upper surface of the head part changes a traveling direction from a radially outward direction for opening the engine valve to a radially inward direction for closing the engine valve. An inlet end part of an oil hole formed in the head part is placed at a radially inside position of the upper surface other than a position where side edges of the rounded cam surface of the swing cam are in contact with the inlet end part of the oil hole when the rounded cam surface is placed in the vicinity of the turn back portion.

14 Claims, 7 Drawing Sheets

ENGINE VALVE LIFTER MECHANISM OF INTERNAL COMBUSTION ENGINE

BACKGROUND OF THE INVENTION

1. Field of the Invention

The present invention relates to engine valve lifter mechanisms of an internal combustion engine, and more particularly to the engine valve lifter mechanisms of a type that is incorporated with a variable valve control device that can adjust a valve lift characteristic of the engine valves, such as, intake valves and/or exhaust valves.

2. Description of the Related Art

Hitherto, various engine valve lifter mechanisms of the above-mentioned type have been proposed and put into practical use particularly in the field of wheeled motor vehicles powered by internal combustion engines.

One of such engine valve lifter mechanisms is disclosed in Japanese Laid-open Patent Application (Tokkai) 2006-57637. The engine valve lifter mechanism disclosed in the Laid-open Application is applied to a reciprocating internal combustion engine and is of a direct operated type installed between a stem end of an intake valve and a rotation cam mounted on a cam shaft.

The engine valve lifter mechanism generally comprises a cylindrical lifter body that is slidably received in a cylindrical guide bore formed in a cylinder head, a circular head that is integrally mounted on an upper end of the lifter body and having an upper surface contactable with the rotation cam, and a cylindrical boss that is projected downward from a center part of the circular head and contactable with the stem end of the intake valve.

The circular head is formed at two given portions thereof with respective oil holes for permitting oil on the upper surface thereof to flow into the interior of the lifter body thereby to apply the oil to a friction generating section between the boss portion and the stem end and a valve spring that is operatively installed in the lifter body.

The oil holes are so positioned that a bearing pressure applied from the rotation cam to the upper surface of the circular head when the rotation cam passes across the oil holes does not exceed a maximum bearing pressure applied to the upper surface when the rotation cam passes across areas other than the oil holes. For this positioning, the two oil holes are placed at diametrically opposed portions of the circular head. That is, during a lift period when the rotation cam causes the intake valve to take an open operation, the bearing pressure exhibits the maximum value at a generally center area of the upper surface of the circular head (viz., the area from which the cylindrical boss is projected downward) and exhibits the minimum value at outer peripheral portions of the circular head due to inevitable layout of the cam shaft on the cylinder head. Thus, the oil holes are arranged at the outer peripheral portions of the circular head where the bearing pressure is sufficiently small.

With the above-mentioned arrangement of the oil holes, increase in the bearing pressure in the vicinity of the oil holes in the period when the rotation cam contacts and presses the circular head is sufficiently controlled, and thus, undesired oil film break on the upper surface of the circular head, which causes deterioration of lubrication, is suppressed. Thus, abrasion of the peripheral edge of each oil hole is suppressed or at least minimized.

SUMMARY OF THE INVENTION

In the above-mentioned engine valve lifter mechanism, the oil holes are positioned at the outer peripheral portions of the circular head where the bearing pressure is sufficiently small.

However, actually, the above-mentioned positioning of the oil holes is employed only in a case wherein the variable valve control device is of a type that uses a rotation cam. That is, if the variable valve control device is of a type that uses a swing cam such as one disclosed in Japanese Laid-open Patent Application (Tokkaihei) 11-107725, the above-mentioned positioning of the oil holes relative to the circular head can not be adopted for the following reasons.

That is, in the latter type using the swing cam, due to a limited layout of a drive shaft, a cam shaft and related other parts, traveling of the swing cam relative to the circular head of the engine valve lifter mechanism takes a unique path. That is, the traveling starts from a start point where a base circle surface of the swing cam contacts a center area of the circular head of the engine valve lifter mechanism, moves radially outward and makes a turn at a peripheral edge portion of the circular head. At the peripheral edge portion of the circular head, the swing cam induces the maximum lift of the valve. Accordingly, the bearing pressure applied to the circular head from the swing cam shows the minimum value at the center area of the circular head and shows the maximum value at the turn back portion of the same.

Accordingly, if the engine valve lifter mechanism used in the variable valve control device of the rotation cam type is practically applied to the variable valve control device of the swing cam type, the bearing pressure shows the maximum value near the oil holes that are arranged at the peripheral portions of the circular head, and thus, undesired oil film break tends to occur near the oil holes. Furthermore, in the variable valve control device of the swing cam type, the power transmission from the drive shaft to the swing cam is carried out by using a multi-link transmission mechanism. However, due to usage of such multi-link transmission mechanism, the swing cam tends to lean in a small but certain degree in the direction of the width of the same for a certain looseness between parts of the multi-link transmission mechanism and a machining accuracy to the parts, which brings about a contact between an outer edge of the cam surface of the swing cam and the peripheral edges of the oil holes inducing the excessive bearing pressure at such areas. Accordingly, due to the above-mentioned oil film break and the excessive bearing pressure at the oil holes, the peripheral edge of each oil hole tends to show undesired abrasion. Even if the upper surface of the circular head is treated with an abrasion resistant layer, possibility of peeling of the layer remains.

It is therefore an object of the present invention to provide an engine valve lifter mechanism which is free of the above-mentioned drawbacks.

In the present invention, unique measures are employed for avoiding undesired contact between a peripheral edge of an oil hole and an outer edge of a cam surface of a swing cam.

In accordance with a first aspect of the present invention, there is provided an engine valve lifter mechanism installed in a variable valve control device of an internal combustion engine, the engine valve lifter mechanism comprising a drive shaft rotatably driven by a crankshaft of the engine and having a drive cam tightly mounted thereon; a swing cam that is swung and has a rounded cam surface; a valve lifter having a head part on which the rounded cam surface is swingably put to induce an open/close operation of an engine valve, the head part having an oil hole pierced therethrough, the oil hole having an inlet end part exposed to an upper surface of the head part; a transmission mechanism that transmits movement of the drive cam to the swing cam while changing the form of the movement from rotation to swinging; and a control mechanism that variably changes attitude of the transmission mechanism in accordance with an operation condition of the engine thereby to variably control a valve lift characteristic of the engine valve, wherein the upper surface of the head part of the valve lifter having a predetermined turn back portion at which, with the variable valve control device kept controlled to induce a maximum lift of the engine valve, a swing stroke of the rounded cam surface relative to the upper surface of the head part changes a traveling direction from a radially outward direction for opening the engine valve to a radially inward direction for closing the engine valve, and wherein the inlet end part of the oil hole is placed at a radially inside position of the upper surface other than a position where side edges of the rounded cam surface of the swing cam are in contact with the inlet end part of the oil hole when the rounded cam surface is placed in the vicinity of the turn back portion.

In accordance with a second aspect of the present invention, there is provided an engine valve lifter mechanism installed in a variable valve control device of an internal combustion engine, the engine valve lifter mechanism comprising a swing cam that is swung and has a rounded cam surface; a valve lifter having a head part on which the rounded cam surface is swingably put to induce an open/close operation of an engine valve, the head part having an oil hole pieced therethrough and the oil hole having an inlet end part exposed to an upper surface of the head part; and a control mechanism that variably changes a swing characteristic of the swing cam thereby to variably control a valve lift characteristic of the engine valve, wherein the inlet end part of the oil hole is placed radially inside of a turn back portion of the upper surface at which, with the variable valve control device kept controlled to induce a maximum lift of the engine valve, a swing stroke of the rounded cam surface relative to the upper surface of the head part changes a traveling direction from a radially outward direction for opening the engine valve to a radially inward direction for closing the engine valve.

In accordance with a third aspect of the present invention, there is provided a valve lifter employed in an engine valve lifter mechanism of an internal combustion engine, the engine valve lifter mechanism including a swing cam that is swingably pressed on a head part of the valve lifter to induce an open/close operation of an engine valve, the valve lifter comprising a boss that is formed on an inner surface of the head part for pressing an end of a stem of the engine valve; and an oil hole formed in the head part at a position between an inner surface of a cylindrical wall of the valve lifter and an outer surface of the boss, the oil hole being positioned nearer to the outer surface of the boss than the inner surface of the cylindrical wall of the valve lifter.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
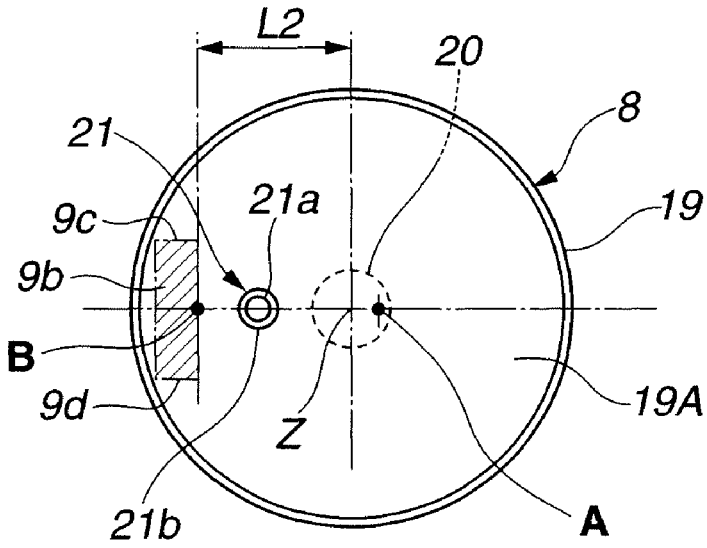
FIG. 1 is a top view of an engine valve lifter mechanism installed in a variable valve control device, that is a first embodiment of the present invention.

In the following, embodiments of the present invention will be described in detail with reference to the accompanying drawings.

For ease of description, various directional terms such as right, left, upper, lower, rightward and the like are used in the following description. However, such terms are to be understood with respect to only the drawing or drawings on which the corresponding part or portion is shown.

Before making the detailed description on the embodiments of the present invention, a variable valve control device of an internal combustion engine to which the present invention is practically applied will be described with the aid of FIG. 3.

Figure 3:
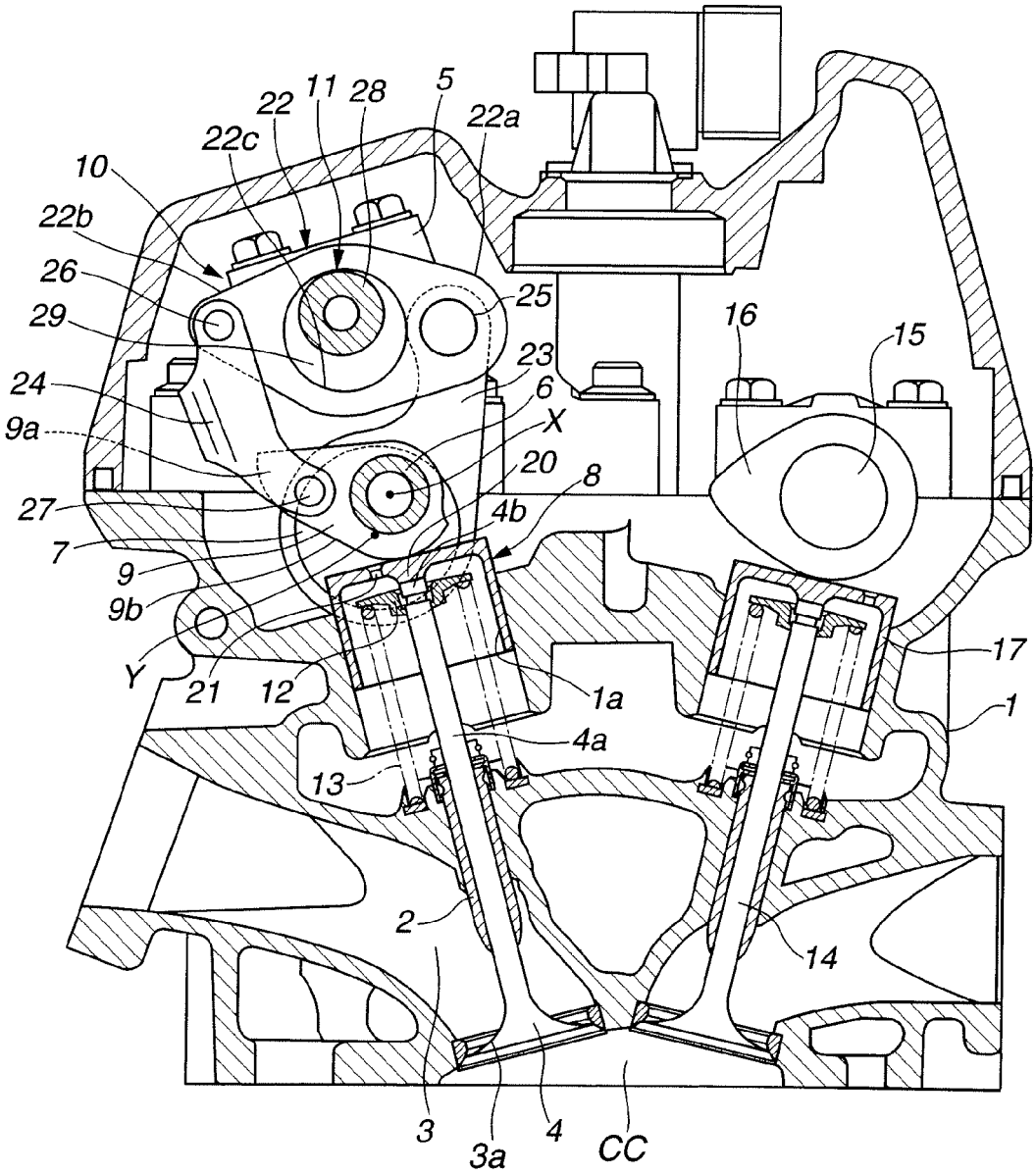
FIG. 3 is a sectional view of an essential portion of the variable valve control device of an internal combustion engine to which the engine valve lifter mechanism of the invention is practically applied.

In FIG. 3, there is shown in a sectional manner the variable valve control device. In the drawing, a left side shows an intake side and a right side shows an exhaust side.

As shown, the exhaust side includes a normal valve actuating mechanism. However, the intake side includes a variable valve control device that can adjust a valve lift characteristic of each intake valve in accordance with an operation condition of an associated internal combustion engine. The basic construction of the variable valve control device is the same as that disclosed in the above-mentioned Japanese Laid-open Patent Application (Tokkaihei) 11-107725.

That is, the variable valve control device installed in the left side is constructed to actuate two intake valves 4 for each cylinder. These intake valves 4 function to open and close respective inlet openings 3*a* of a combustion chamber "CC" formed in a cylinder head 1. Inlet openings 3*a* constitute terminal ends of intake ports 3 as shown in the drawing. Each intake valve 4 has a stem 4*a* slidably received in a cylindrical valve guide 2 that is installed in cylinder head 1.

The variable valve control device comprises a hollow drive shaft 6 that is rotatably held by bearing structures 5 mounted on cylinder head 1, an eccentric drive cam 7 that is tightly mounted on drive shaft 6, a pair of swing cams 9 that are swingably held by drive shaft 6 for actuating intake valves 4 through respective valve lifters 8, a multi-link transmission mechanism 10 that is arranged between drive cam 7 and the pair of swing cams 9 to transmit movement of drive cam 7 to swing cams 9 while changing the form of the movement from rotation to swinging, and a control mechanism 11 that variably controls or adjusts operation characteristic of multi-link transmission mechanism 10.

As shown, each intake valve 4 is biased in a direction to close inlet opening 3*a* by a valve spring 13 that is compressed between a spring retainer 12 fixed to a stem end 4*b* of valve stem 4*a* and a deck part of cylinder head 1.

As shown, the normal valve actuating mechanism for two exhaust valves 14 comprises generally an exhaust cam shaft 15, two rotation cams 16 tightly mounted on exhaust cam shaft 15 and two valve lifters 17.

Referring back to the intake side, drive shaft 6 is arranged to extend in an axial direction of the associated internal combustion engine. Drive shaft 6 has at one end a driven sprocket (not shown) around which a timing chain or the like is operatively put to transmit a turning force of a crankshaft of the engine to drive shaft 6. In FIG. 3, due to such turning force, drive shaft 6 is rotated in a counterclockwise direction.

Drive cam 7 is in the shape of circular disc and is tightly mounted eccentrically on drive shaft 6. That is, upon mounting, a center "Y" of drive cam 7 is offset from an axial center "X" of drive shaft 6 by a certain degree.

Figure 2:
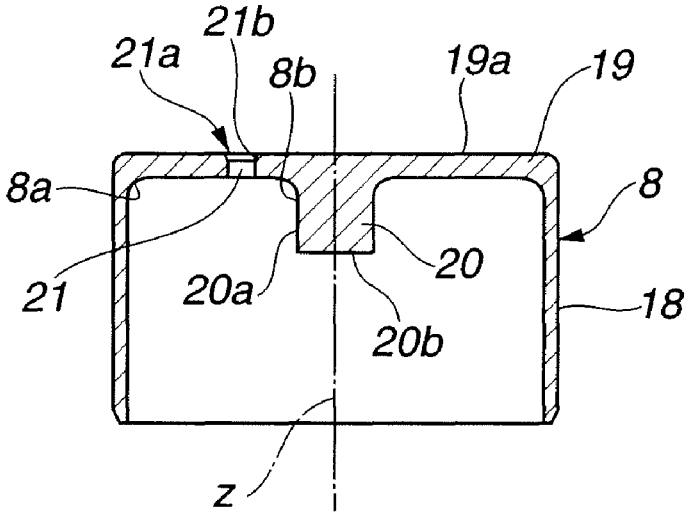
FIG. 2 is a sectional view of the engine valve lifter mechanism of the first embodiment.

As is seen from FIGS. 1 and 2, each valve lifter 8 is an integral member constructed of steel comprising a lifter body 18 that has a thinner cylindrical wall, a circular head 19 that is integrally mounted on an upper end of lifter body 18, and a cylindrical boss 20 that is projected downward from a center part of circular head 19. Cylindrical boss 20 has a lower end surface 20*b* contactable with an upper stem end 4*b* of one corresponding intake valve 4 (see FIG. 3).

As is seen from FIG. 3, valve lifter 8 is slidably received in an inclined guide bore 1*a* that is formed in cylinder head 1 at a position above the corresponding intake port 3.

As is seen from FIG. 2, circular head 19 has a flat top surface 19*a* that is treated with an abrasion resistant layer. For example, as the abrasion resistant layer, Chromnitride (CrN) film or Titannitride (TiN) film produced through ion-deposition method is used.

As is seen from FIG. 2, an inner surface of lifter body 18 and that of circular head 19 are integrally connected to form an outer concaved annular surface 8*a*, and the inner surface of circular head 19 and an outer surface 20*a* of cylindrical boss 20 are integrally connected to form an inner concaved annular surface 8*b*. As shown, an axis "Z" of lifter body 18 passes through a center of circular boss 20. That is, circular boss 20 is concentric with lifter body 18. Furthermore, cylindrical boss 20 has a flat lower end 20*b*.

As is seen from FIGS. 1 and 2, circular head 19 is formed at a given portion thereof with a cylindrical oil hole 21 that extends axially. Oil hole 21 has a given inner diameter, and as is seen from FIG. 2, an inlet part 21*a* of oil hole 21 is chamfered as is indicated by numeral 21*b*. The chamfered surface may be flat or concaved in shape.

The positioning of oil hole 21 is determined based on an after-mentioned bearing pressure applied to the flat top surface 19*a* of circular head 19 from a rounded cam surface 9*b* of the corresponding swing cam 9. The detail of the positioning of oil hole 21 will be described hereinafter.

It is to be noted that, as is seen from FIG. 3, upon receiving a pressure from swing cam 9, valve lifter 8 is shifted downward while being permitted to turn slowly in a circumferential direction in guide bore 1*a*.

As is seen from FIG. 3, each swing cam 9 is in the shape of raindrop and has a generally annular base portion rotatably disposed about drive shaft 6. A cam nose portion 9*a* of swing cam 9 is formed with a pin hole (no numeral). Swing cam 9 is formed at a lower side thereof with rounded cam surface 9*b*.

That is, rounded cam surface 9*b* comprises a base rounded surface part (or base circle surface part) provided around the annular base portion of swing cam 9, a rounded ramp surface part that extends from the base rounded surface part toward cam nose portion 9*a*, and a maximum lift surface part that is provided at the leading end of the rounded ramp surface part for providing the corresponding intake valve 4 with the maximum lift.

Under operation of the variable valve control device, due to the swing movement of swing cam 9, the three surface parts, viz., the base rounded surface part, the rounded ramp surface part and the maximum lift surface part, are brought into contact with flat top surface 19*a* of circular head 19 of valve lifter 8 one after another.

Figure 4:
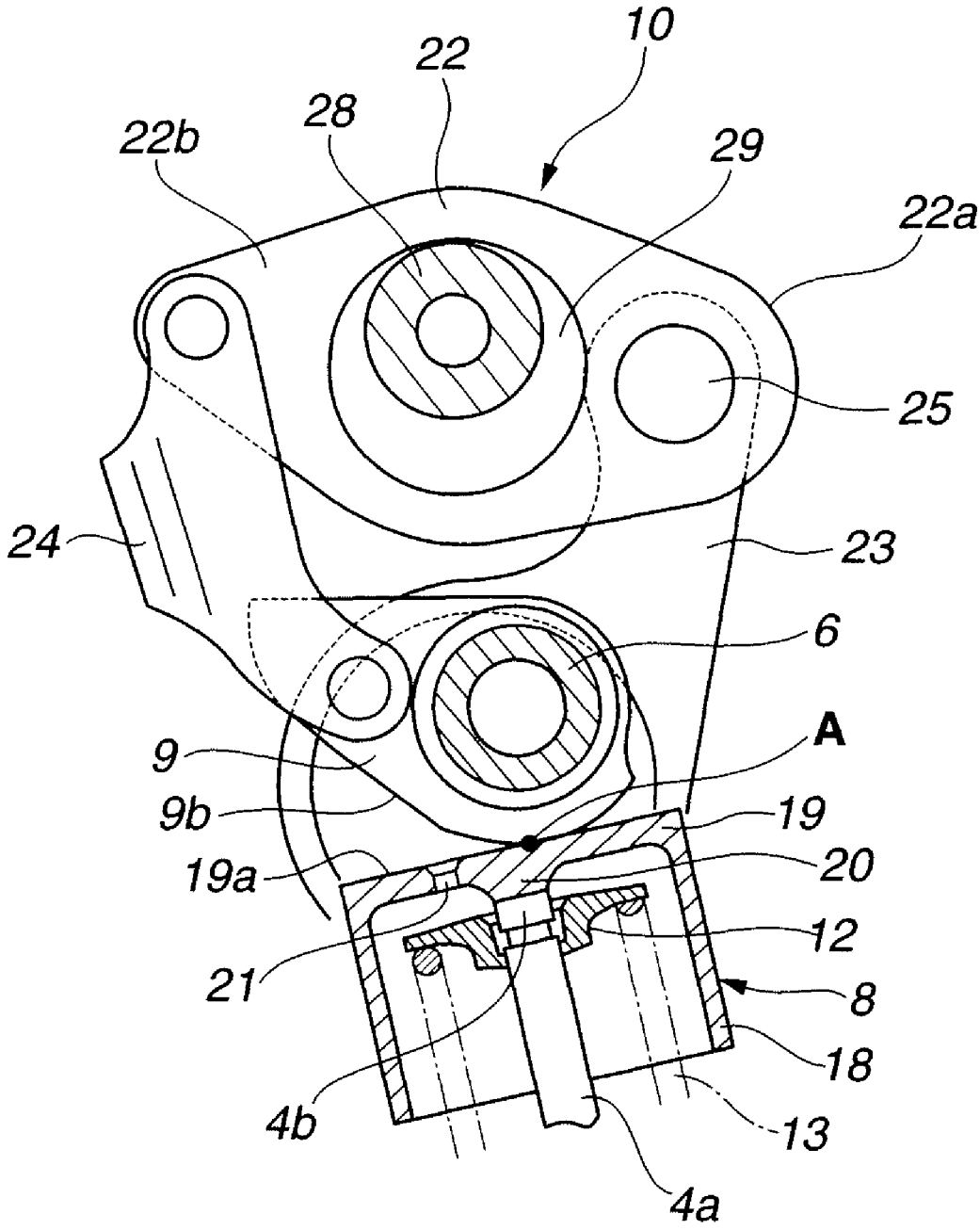
FIG. 4 is a sectional view of a valve actuating mechanism of the variable valve control device, showing a condition wherein a swing cam assumes a swing start (or end) position with respect to a circular head of the engine valve lifter mechanism under a large lift control.
Figure 5:
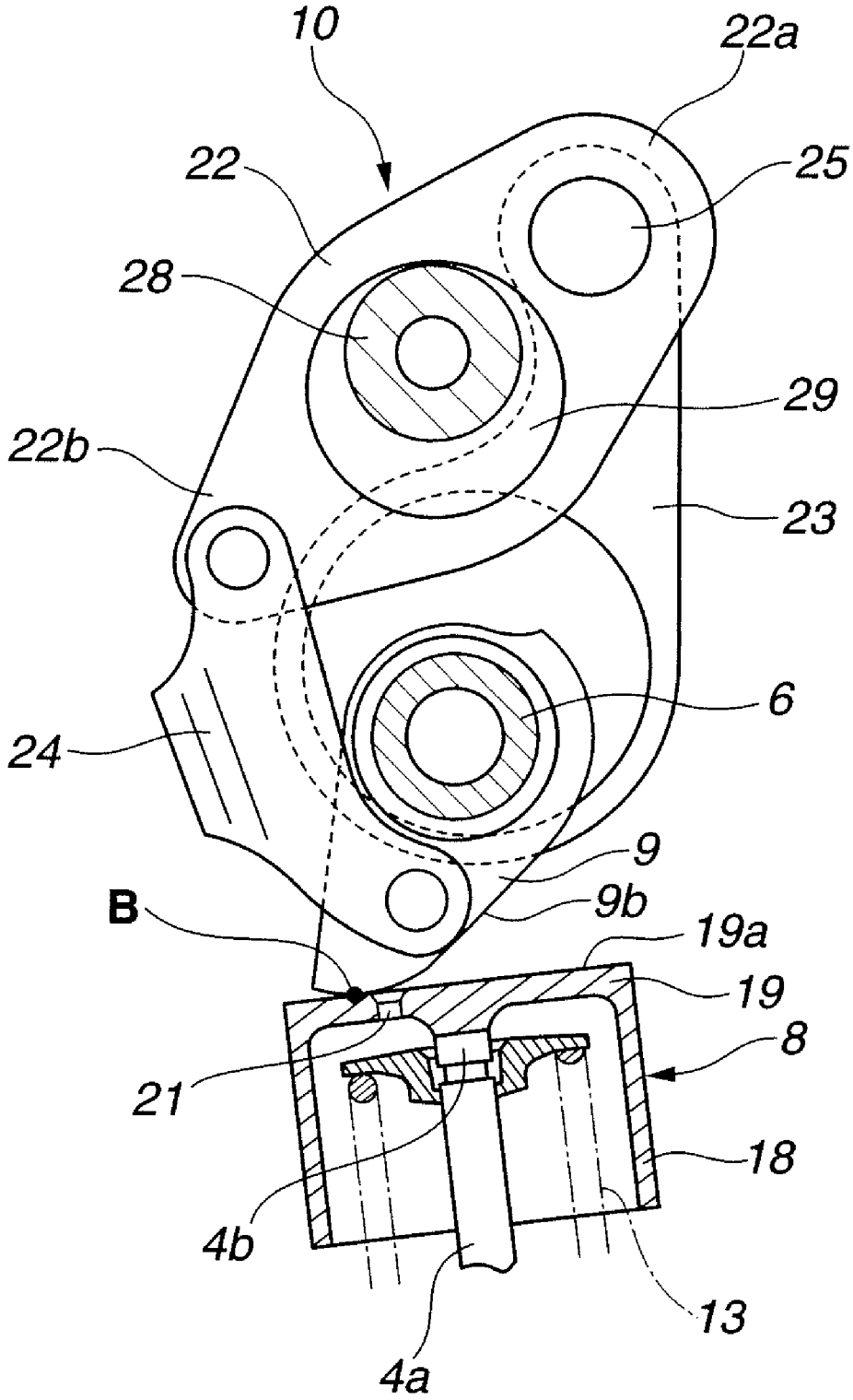
FIG. 5 is a view similar to FIG. 4, but showing a condition wherein the swing cam assumes a turn back position with respect to the circular head of the engine valve lifter mechanism.

That is, as is seen from FIGS. 4 and 5, in the period wherein swing cam 9 operates to induce an opening movement of the corresponding intake valve 4, rounded cam surface 9*b* is turned counterclockwise in FIG. 4 continuously changing an actually pressing point thereof, which actually contacts with flat top surface 19*a*, from a generally center area of flat top surface 19*a* (see FIG. 4) toward a radially outside area of the same (see FIG. 5). As shown in FIG. 4, when the base rounded surface part of rounded cam surface 9*b* contacts with flat top surface 19*a*, the actually pressing point of rounded cam surface 9*b* takes a position "A" near the generally center area of flat top surface 19*a* of circular head 19. While, as shown in FIG. 5, when the maximum lift surface part of rounded cam surface 9*b* contacts with flat top surface 19*a*, the actually pressing point of rounded cam surface 9*b* takes a position "B" near the radially outside area of flat top surface 19*a*.

It is to be noted that the above-mentioned counterclockwise swing of swing cam 9, that is, the swing in the direction from the contact with point "A" to the contact with point "B" coincides with the rotational direction of drive shaft 6.

As will become apparent as the description proceeds, multi-link transmission mechanism 10 is constructed to transmit movement of eccentric drive cam 7 to both swing cams 9 while changing the form of the movement from rotation to swinging.

As will be understood from FIG. 3, multi-ink transmission mechanism 10 comprises a rocker arm 22 that is arranged above an intermediate position of the paired swing cams 9 and swingably held by an after-mentioned control shaft 28, a link arm 23 that links an end 22*a* of rocker arm 22 to eccentric drive cam 7, and a pair of link rods 24 that link a forked end 22*b* of rocker arm 22 to the two swing cams 9 respectively.

Rocker arm 22 comprises a cylindrical base portion that is rotatably disposed on an after-mentioned control cam 29 through a cam hole 22*c*, and first and second end portions 22*a* and 22*b* that radially extend in opposite directions from the cylindrical base portion.

As is seen from FIG. 3, the end 22*a* of rocker arm 22 and an upper end of link arm 23 are pivotally connected through a connecting pin 25, and the forked other ends 22*b* of rocker arm 22 and upper ends of the paired link rods 24 are pivotally connected through a common connecting pin 26.

Link arm 23 comprises a larger annular base portion and a projected portion that extends radially outward from the base portion. The base portion is formed with a circular opening in which the above-mentioned eccentric drive cam 7 is rotatably and slidably received. The projected portion is pivotally connected to the end 22*a* of rocker arm 22 through connecting pin 25.

Each link rod 24 is slightly bent in shape and has an upper end pivotally connected to one of the other ends 22*b* of rocker arm 22 through connecting pin 26 and a lower end pivotally connected to the nose portion 9*a* of one of swing cams 9 through connecting pin 27, as shown.

Although not well shown in the drawing, each connecting pin 25, 26 or 27 is provided with a snap ring for regulating an axial shift of rink arm 23 and rink rods 24.

Control mechanism 11 comprises control shaft 28 that is arranged above drive shaft 6 and control cam 29 that is tightly mounted on control shaft 28 to be slidably received in cam hole 22*c* of rocker arm 22. Control shaft 28 is also supported by the above-mentioned bearing structures 5.

As is understood from the drawing (viz., FIG. 3), control shaft 28 extends in parallel with drive shaft 6 and has one end operatively connected to an electromagnetic actuator (not shown). That is, the actuator is constructed to turn control shaft 28 to a desired angular position. More specifically, upon receiving an instruction signal from a control unit (not shown) that analyzes an operation condition of the associated internal combustion engine and issues the instruction signal, the actuator turns control shaft 28 to an instructed angular position. The control unit is a microcomputer that includes CPU (central processing unit), ROM (read only memory), RAM (random access memory) and Input/Output interfaces. That is, upon receiving and analyzing information signals from various sensors, such as a crank angle sensor, an air flow meter, an engine cooling water temperature sensor and the like, the control unit computes the existing operation condition of the engine and issues a corresponding instruction signal to the electromagnetic actuator for the controlled turning of control shaft 28.

Control cam 29 is in the shape of a cylinder, and as is seen from FIG. 3, control cam 29 is tightly and eccentrically mounted on control shaft 28. Although not well shown in the drawing, an axial length of control cam 29 is substantially the same as a thickness of the cylindrical base portion of rocker arm 22.

In the following, positioning of oil hole 21 formed in circular head 19 of each lifter 8 will be described in detail with reference to the drawings.

As will become apparent as the description proceeds, the oil hole 21, more-specifically, the chamfered inlet part 21*a* of the same is positioned at a certain part (21) of flat top surface 19*a* of circular head 19 that not only receives the maximum bearing pressure from the corresponding swing cam 9 while the swing cam 9 takes a traveling range that provides the corresponding intake valve 4 with the great lift, but also keeps away from side edges 9*c* and 9*d* (see FIG. 7) of rounded cam surface 9*b* of swing cam 9 that are defined when swing cam 9 makes a turn back during its swing movement.

Figure 6:
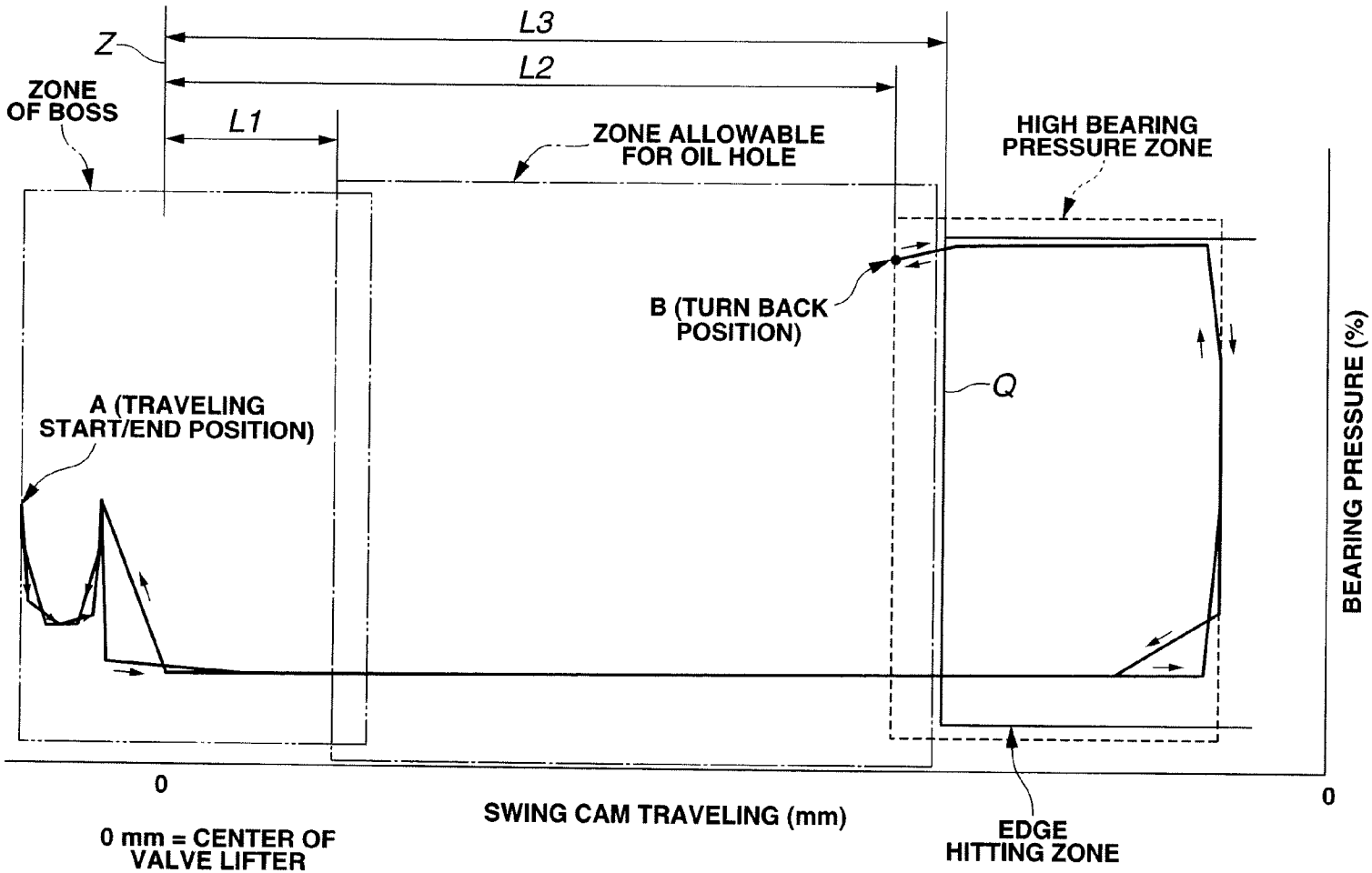
FIG. 6 is a characteristic graph showing a relationship between a traveling of the swing cam and a bearing pressure applied to the engine valve lifter mechanism.

The above-mentioned positional relation will be much clearly understood from the following description with the aid of the drawings of FIGS. 4 to 6.

For ease of understanding, the following description will be directed 25, to one cycle (or travel) of intake valve 4 that starts from a valve close condition as shown in FIG. 4, undergoes a valve open condition as shown in FIG. 5 and comes back to the valve close condition of FIG. 4.

The one cycle (or travel) is depicted by a graph of FIG. 6. The graph indicates by the vertical line the bearing pressure applied to circular head 19 of the lifter 8 and by the horizontal line the travel of swing cam 9.

As is indicated by a thicker solid line in the graph, for a period from a time when, as is seen from FIG. 4, the base rounded surface part of rounded cam surface 9*b* contacts flat top surface 19*a* of circular head 19 at point "A" to a time when the rounded ramp surface of rounded cam surface 9*b* is turned to contact flat top surface 19*a*, the bearing pressure is low.

However, when the lift surface part of rounded cam surface 9*b* comes into contact with flat top surface 19*a* of circular head 19, the bearing pressure shows a high level as is indicated by a rectangular illustrated by a broken line. That is, in the valve opening stroke, the bearing pressure shows the high level in a given range.

Thereafter, swing cam 9 swings from a position of maximally opening intake valve 4 and arrives at the turn back portion (viz., the position "B" in FIG. 5). Until this turn back portion, the high bearing pressure is kept. Then, swing cam 9 swings back shifting its contact area against flat top surface 19*a* of circular head 19 from the lift surface part to the rounded ramp surface part. During this, the high bearing pressure is kept. It is to be noted that the zone that exhibits the high bearing pressure is indicated by the rectangular illustrated by the broken line in FIG. 6 and indicated by a slashed rectangular zone in FIG. 1.

Thereafter, swing cam 9 swings shifting its contact area from the rounded ram surface part to the base rounded surface part. Upon this, the bearing pressure becomes down rapidly and the intake valve 4 is moved to the close position with the aid of the biasing force of valve spring 13.

Figure 7:
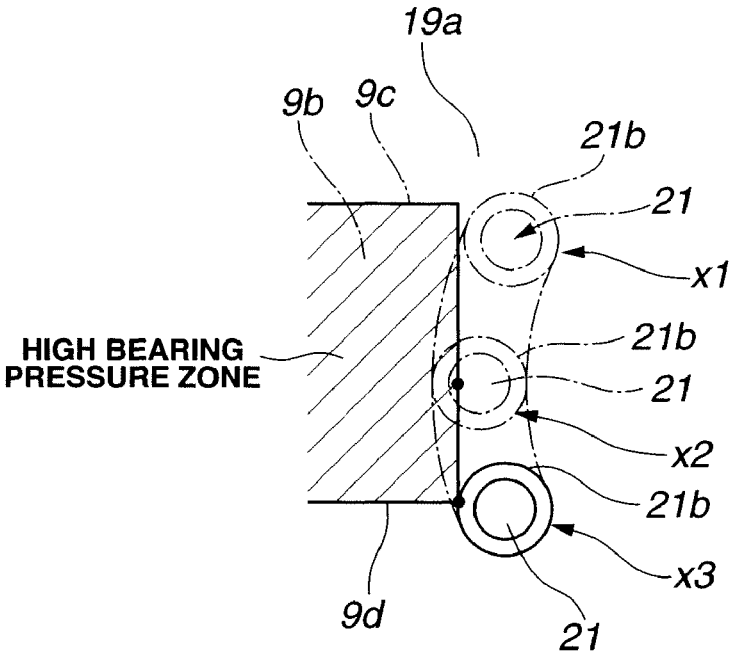
FIG. 7 is an illustration showing various positions of an oil hole provided by a circular head of the engine valve lifter mechanism.

The rectangular zone indicated by a solid line in FIG. 6 depicts an initial stage of the high bearing pressure produced during the swinging contact of rounded cam surface 9*b* against flat top surface 19*a* of circular head 19 at the time when as is seen from FIG. 7 side edges 9*c* and 9*d* of rounded cam surface 9*b* are in contact with the chamfered inlet part 21*a* of oil hole 21.

It is to be noted that FIG. 7 shows a positional relation between the above-mentioned high bearing pressure zone (slashed zone) of flat top surface 19*a* and the above-mentioned side edges 9*c* and 9*d* of rounded cam surface 9*b* plotting various positions (three positions in the illustrated exemplified case) of oil hole 21 and shows two positions (x1 and x2) where the chamfered end 21*b* of inlet part 21*a* of oil hole 21 is not in contact with any of side edges 9*c* and 9*d* and one position (x3) where the chamfered end 21*b* is in contact with one (viz., 9*d*) of side edges 9*c* and 9*d*.

Referring back to the graph of FIG. 6, reference "L1" denotes a distance between an axis "Z" (see FIGS. 1 and 2) of cylindrical boss 20 of valve lifter 8 and the cylindrical outer surface 20*a* of cylindrical boss 20 (that is, a radius of the boss 20), reference "L2" denotes a distance between the axis "Z" and the above-mentioned turn back position "B", and reference "L3" denotes a distance between the axis "Z", and the nearest position "Q" to the axis "Z" of a zone where the chamfered end 21*b* of oil hole 21 is in contact with at least one of side edges 9*c* and 9*d* of rounded cam surface 9*b* of swing cam 9.

In the first embodiment of the present invention, the oil hole 21 in flat top surface 19*a* of circular head 19 is constructed to satisfy the following positional relationship.

That is, as is seen from FIGS. 6 and 7, even in the high bearing pressure zone, there is a limited zone (x1 and x2 in FIG. 7) near the turn back position "B" where the chamfered inlet part 21*b* of oil inlet is not in contact with any of side edges 9*c* and 9*d* of rounded cam surface 9*b*. In other words, such limited zone can be practically defined or prepared on flat top surface 19*a* of circular head 19 of valve lifter 8.

Accordingly, as is seen from the graph of FIG. 6, oil hole 21 can be placed at any position within a rectangular zone indicated by the alternate long and short dash line. As shown, the rectangular zone is defined inside the position "Q" and outside the outer surface 20*a* of cylindrical boss 20. In the illustrated first embodiment, as is seen from FIGS. 1 and 2, the oil hole 21 is placed at a generally middle position between the turn back position "B" and the outer surface 20*a* of boss 20.

In the following, operation of the variable valve control device to which the first embodiment is practically applied will be described with the aid of the drawings.

When the associated engine is under a low speed and low load operation mode such as a mode established just after engine starting, the electromagnetic actuator (not shown) turns control shaft 28 of control mechanism 11 (see FIG. 3) in a direction to move a thicker part of control cam 29 upward in FIG. 3 upon receiving an instruction signal from the control unit (not shown) that is monitoring an existing operation condition of the engine. With this, the swing fulcrum of rocker arm 22 is shifted upward causing the forked end 22*b* thereof to raise slightly cam nose portions 9*a* of swing cams 9 through link rods 24, and thus, each swing cam 9 is forced to turn clockwise in FIG. 3 by a given degree about drive shaft 6.

When, under the above-mentioned condition of swing cams 9, drive shaft 6 is rotated by the engine, drive cam 7 is rotated together with drive shaft 6 in the same direction. Rotation of drive cam 7 induces swing movement of swing cams 9 due to operation of above-mentioned multi-link transmission mechanism 10.

When the base rounded surface part of each swing cam 9 is placed on flat top surface 19*a* of circular head 19 of the corresponding valve lifter 8, the corresponding intake valve 4 assumes the close position. This condition will be well understood with reference to FIG. 4. But, in FIG. 4, the thicker part of control cam 29 takes a lower position, which will be described hereinafter.

When, with the above-mentioned condition control cam 29 kept unchanged, drive cam 7 is turned in a counterclockwise direction in FIG. 3, link arm 23 is shifted upward pushing up the end 22*a* of rocker arm 22. With this, rocker arm 22 is swung in a counterclockwise direction about control cam 29 pushing down link rods 24 by the forked end 22*b*. Thus, each swing cam 9 is forced to swing in a counterclockwise direction starting a cam lift operation to open the corresponding intake valve 4. This operation will be well understood with reference to FIG. 4. But, as is mentioned hereinabove, in FIG. 4, the thicker part of control cam 29 takes the lower position.

When rotation of drive cam 7 is advanced, each swing cam 9 is further swung in the counterclockwise direction and finally comes to the turn back position wherein the maximum lift surface part of rounded cam surface 9*b* contacts flat top surface 19*a* of valve lifter 8. Upon this, the corresponding intake valve 4 assumes its full open position. This operation will be well understood with reference to FIG. 5. But, in FIG. 5, the thicker part of control cam 29 takes the lower position.

When rotation of drive cam 7 is further advanced, each swing cam 9 is forced to swing back in a clockwise direction from the turn back position due to the function of the multi-link transmission mechanism 10. That is, a cam down operation to close the corresponding intake valve 4 is started.

When rotation of drive cam 7 is still further advanced, clockwise swing of swing cam 9 takes swing cam 9 to the original position where the base rounded surface part of swing cam 9 is placed on flat top surface 19*a* of the valve lifter 8 causing the intake valve 4 to assume the close position.

Due to the above-mentioned slight rise of cam nose portion 9*a* of swing cam 9 by the control shaft 28, the corresponding intake valve 4 is forced to repeat the open/close operation with a smaller valve lift characteristic. As is known, in such smaller valve lift characteristic, intake gas flow is enhanced and thus satisfied fuel consumption is expected.

While, when the engine is shifted to a high speed and high load operation mode, the electromagnetic actuator (not shown) turns control shaft 28 to the angular position where as is seen from FIGS. 3 to 5, the thicker part of control cam 29 takes the lower position. With this, the swing fulcrum of rocker arm 22 is shifted downward toward drive shaft 6 causing the forked end 22*b* thereof to push down cam nose portions 9*a* of swing cams 9 through link rods 24, and thus, each swing cam 9 is forced to turn counterclockwise in FIG. 3 by a given degree about drive shaft 6.

Accordingly, the contact portion of rounded cam surface 9*b* of swing cam 9 to flat top surface 19*a* of the corresponding valve lifter 8 shifts leftward in FIG. 3.

When, with the above-mentioned condition of control cam 29 kept unchanged, drive cam 7 is turned in a counterclockwise direction in FIG. 3, link arm 23 is shifted upward pushing up the end 22*a* of rocker arm 22.

It is now to be noted that due to the above-mentioned downward shifting of the swing fulcrum of rocker arm 22, the valve lift degree against the valve lifter 8 by swing cam 9 is increased. That is, the corresponding intake valve 4 is forced to repeat the open/close operation with a larger valve lift characteristic by receiving an operation force from drive cam 7 in the above-mentioned manner.

Thus, in the high speed and high load operation mode of the engine, the cam lift characteristic is larger than that established in the above-mentioned low speed and low load operation mode of the engine, and thus, in the high speed and high load operation mode, the intake valve 4 exhibits a large valve lift, early open timing and slow close timing as compared with the case in the low speed and low load operation mode. Thus, as is known, in such larger valve lift characteristic, intake charging efficiency is enhanced and thus satisfied engine power is expected.

During the above-mentioned operation, the lubrication oil dropping onto flat top surface 19*a* of each valve lifter 8 flows on the surface 19*a* and some of the oil flows toward oil hole 21 and enters the hole 21 from the chamfered inlet part 21*b*. The lubrication oil then flows on the lower surface of circular head 19 and the outer surface 20*a* of cylindrical boss 20 and comes to a contact portion between the lower end surface 20*b* of boss 20 (see FIG. 2) and upper stem end 4*b* of intake valve 4 (see FIG. 3). As is understood from FIG. 3, part of the lubrication oil flows down from the upper surface of spring retainer 12 to the lower surface of the same, then to a contact part of spring retainer 12 with an upper end of valve spring 13 and then to a lower contact part of valve spring 13 with the deck part of cylinder head 1. With application of the lubrication oil, the contact pars are well lubricated. As is seen from FIG. 2, due to provision of the concaved annular surface 8*b* provided between the inner surface of circular head 19 and the outer surface 20*a* of cylindrical boss 20, the downward flow of lubrication oil from the inner surface of circular head 19 to the outer surface 20*a* of cylindrical boss 20 is smoothly made.

As is understood from the foregoing description, in this first embodiment, oil hole 21 is placed at a position other than the high bearing pressure zone that is produced by rounded cam surface 9*b* of swing cam 9. Thus, even when rounded cam surface 9*b* of swing cam 9 is swung to a position to contact the chamfered inlet end 21*b* of oil hole 21, the chamfered inlet end 21*b* is not affected by high bearing pressure and thus undesired oil film break on flat top surface 19*a* of circular head 19 is avoided. This means that flat top surface 19*a* is constantly covered with the oil film.

Furthermore, in this first embodiment, the oil hole 21 is placed at a position other than the position where any one of side edges 9*c* and 9*d* of rounded cam surface 9*b* becomes in contact with the chamfered inlet end 21*b* of oil hole 21 when swing cam 9 is under a swing movement to induce opening operation of the intake valve 4. Thus, generation of excessive bearing pressure at the chamfered inlet end 21*b* of oil hole 21 is assuredly prevented.

For the reasons as mentioned hereinabove, undesired peeling and/or abrasion of the flat top surface 19*a* of lifter body 18 is suppressed.

Figure 8:
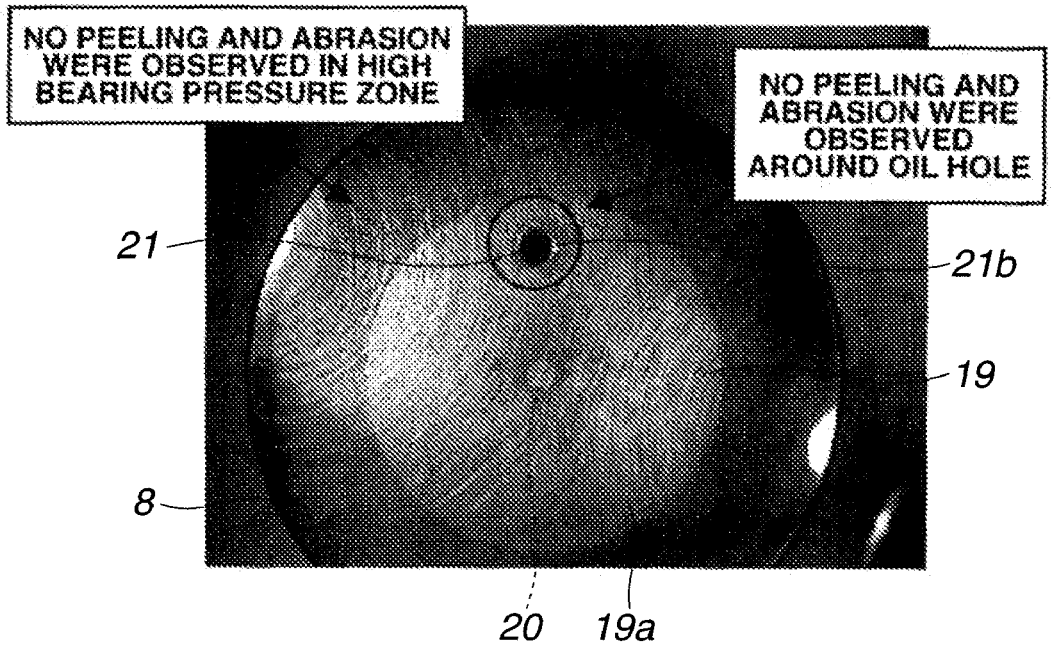
FIG. 8 is a photographic view of an upper surface of the circular head used in the first embodiment, showing the results of an abrasion test applied to the upper surface.
Figure 9:
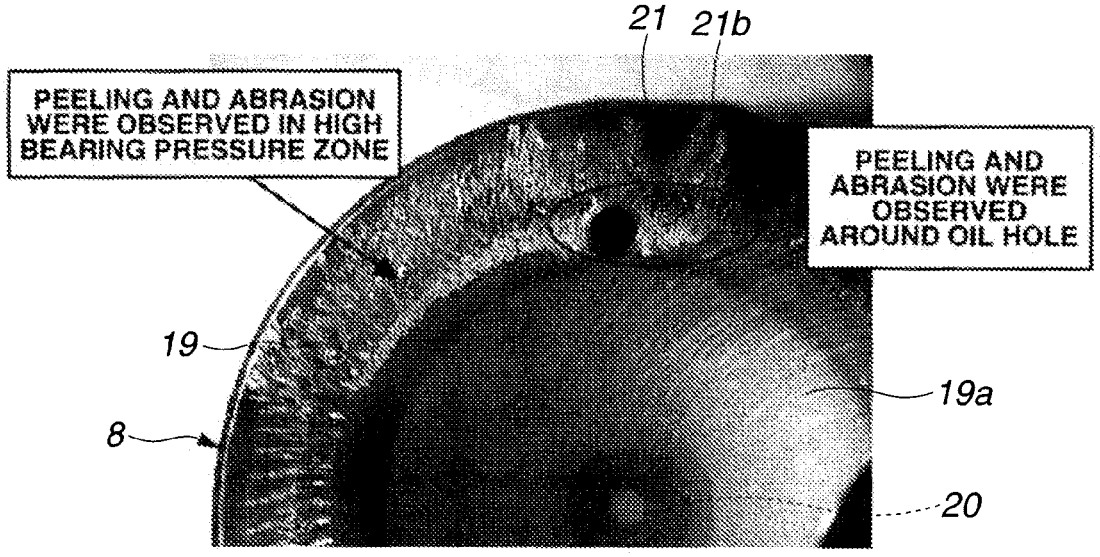
FIG. 9 is a view similar to FIG. 8, but showing the results of the abrasion test in case wherein the circular head is formed with the oil hole at a peripheral portion.

FIGS. 8 and 9 are photographic views showing the results of an abrasion test applied to the flat top surface of the circular head of the valve lifter, in case of the first embodiment of the invention and a conventional engine valve lifter mechanism, respectively. Actually, for the test, the engine valve lifter mechanism of the first embodiment and the conventional engine valve lifter mechanism were practically installed in a variable valve control device.

As is seen from FIG. 9, in case of the conventional engine valve lifter mechanism wherein oil hole 21 is positioned at the so-called high bearing pressure zone of flat top surface 19*a* of circular head 19, that is, near the peripheral area of flat top surface 19*a*, remarked peeling and abrasion were observed at an area near the chamfered inlet end 21*b* of oil hole 21. Inventors consider that such undesired phenomena were caused by a so-called edge hitting which would occur between any one of side edges 9*c* and 9*d* of rounded cam surface 9*b* and the chamfered inlet end 21*b* of oil hole 21.

While, as is seen from FIG. 8, in case of the engine valve lifter mechanism of the first embodiment wherein oil hole 21 is placed at a generally middle position between the turn back position "B" and the outer surface 20*a* of cylindrical boss 20, undesired peeling and abrasion were not observed at the area near the chamfered inlet end 21*b* of oil inlet 21. Inventors consider that in the first embodiment, the edge hitting did not take place because of the ideal positioning of oil inlet 21.

Furthermore, in the first embodiment, the test results revealed that undesired peeling was not observed even at the high bearing pressure zone of the flat top surface 19*a*. Inventors consider that this was also caused by the ideal positioning of oil hole 21.

In this first embodiment, due to swing movement (or stroke) of swing cam 9, valve lifter 8 is subjected to a slight swing movement about its axis "Z" that causes a slight swing shifting of position of oil hole 21. Thus, flowing of lubrication oil on flat top surface 19*a* toward oil hole 21 is promoted, and thus, feeding of lubrication oil to friction generating sections is improved even if valve lifter 8 is inclined like in the case of the illustrated variable valve control device.

Figure 10:
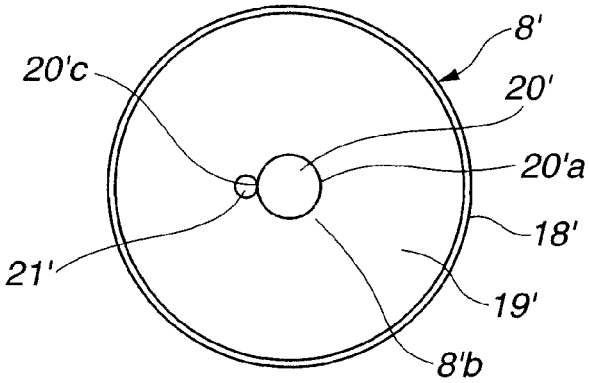
FIG. 10 is a bottom view of an engine valve lifter mechanism employed in a second embodiment of the present invention.
Figure 11:
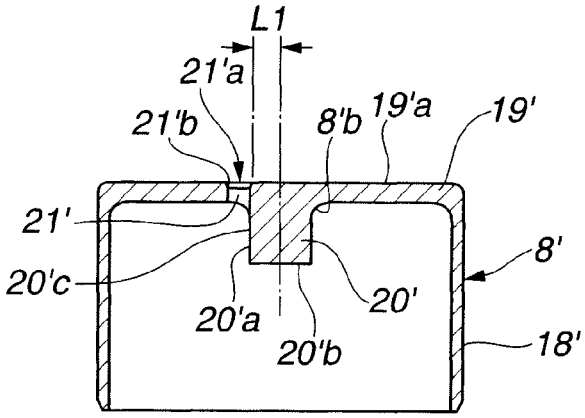
FIG. 11 is a view similar to FIG. 2, but showing the second embodiment of the present invention.

Referring to FIGS. 10 and 11, there is shown a valve lifter 8' employed in an engine valve lifter mechanism of a second embodiment of the present invention. It is to be noted that FIG. 10 is a bottom view of valve lifter 8'. As shown, in this second embodiment, oil hole 21' is placed at another position.

More specifically, as is seen from these drawings, in this second embodiment, oil hole 21' is positioned just beside cylindrical boss 20' of circular head 19' of valve lifter 8'. That is, as shown, oil hole 21' is placed in concaved annular surface 8'*b* provided between the inner surface of circular head 19' and the outer surface 20'*a* of boss 20'. That is, as is seen from the drawings, a radially inside outlet end of oil hole 21' is merged with outer surface 20'*a* of boss 20'.

Accordingly, in this second embodiment, the lubrication oil led into oil hole 21' from flat top surface 19'*a* of lifter 8' directly flows onto the outer surface 20'*a* of boss 20' and thus instantly reaches the friction section between lower end surface 20'*b* of boss 20' and the upper stem end of the corresponding intake valve 4 (see FIG. 3) and other friction generating sections such as those mentioned hereinabove.

Because of the above-mentioned positioning of oil hole 21', cylindrical boss 20' can serve as reinforcing means for oil hole 21'. Accordingly, undesired lowering in mechanical strength of circular head 19' due to formation of oil hole 21' is suppressed or at least minimized.

In the foregoing description, the description is directed to the valve lifters 8 and 8' for intake valves 4. Of course, the invention is applicable to valve lifters for exhaust valves. Furthermore, in the invention, two and more oil holes may be provided subject to the above-mentioned conditions.

The entire contents of Japanese Patent Application 2006-314953 filed Nov. 22, 2006 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. An engine valve lifter mechanism installed in a variable valve control device of an internal combustion engine, comprising:

a drive shaft configured to be rotatably driven by a crankshaft of the engine and having a drive cam tightly mounted thereon;

a swing cam being configured to swing and having a rounded cam surface;

a valve lifter having a head part on which the rounded cam surface is swingably disposed for inducing an open/close operation of an engine valve, the head part having an oil hole pierced therethrough, the oil hole having an inlet end part exposed to an upper surface of the head part;

a transmission mechanism configured to transmit movement of the drive cam to the swing cam while changing the form of the movement from rotation to swinging; and a control mechanism configured to variably change attitude of the transmission mechanism in accordance with an operation condition of the engine such that a valve lift characteristic of the engine valve is variably controlled, wherein the upper surface of the head part of the valve lifter has a predetermined turn back position at which the rounded cam surface of the swing cam contacts at a time when the swing cam changes its swing direction from a direction to increase an open degree of the engine valve to a direction to decrease the open degree of the engine valve while inducing a maximum lift of the engine valve, and, wherein the inlet end part of the oil hole is placed at a radially inside position of the upper surface of the head part with respect to the predetermined turn back position, the radially inside position being other than one of the positions where side edges of the rounded cam surface of the swing cam contact the upper surface of the head part.

2. An engine valve lifter mechanism as claimed in claim 1, wherein the upper surface of the head part of the valve lifter is treated with an abrasion resistant layer.

3. An engine valve lifter mechanism as claimed in claim 1, wherein the inlet end part of the oil hole is placed at a given position of a high bearing pressure zone of the upper surface of the head part that appears when, with the variable valve control device being controlled to induce the maximum lift of the engine valve, a swing stroke of the rounded cam surface relative to the upper surface of the head part is advanced from a radially inner portion of the upper surface to a radially outer portion of the upper surface, the given position being other than one of the positions where the side edges of the rounded cam surface of the swing cam contact the upper surface of the head part.

4. An engine valve lifter mechanism installed in a variable valve control device of an internal combustion engine, comprising:

a swing cam configured to swing and having a rounded cam surface;

a valve lifter having a head part on which the rounded cam surface is swingably disposed for inducing an open/close operation of an engine valve, the head part having an oil hole pieced therethrough and the oil hole having an inlet end part exposed to an upper surface of the head part; and a control mechanism configured to variably change a swing characteristic of the swing cam such that a valve lift characteristic of the engine valve is variably controlled, wherein the inlet end part of the oil hole is placed radially inside of a turn back portion of the upper surface at which, with the variable valve control device being controlled to induce a maximum lift of the engine valve, a swing stroke of the rounded cam surface relative to the upper surface of the head part changes a traveling direction from a radially outward direction for opening the engine valve to a radially inward direction for closing the engine valve.

5. An engine valve lifter mechanism as claimed in claim 4, wherein the oil hole is placed between an outer surface of a boss formed on a generally center part of an inner surface of the head part and a radially inside position of the turn back portion.

6. An engine valve lifter mechanism as claimed in claim 5, wherein the oil hole is placed at a generally middle position between the outer surface of the boss and the turn back portion.

7. An engine valve lifter mechanism as claimed in claim 5, wherein the inner surface of the head part and the outer surface of the boss are integrally connected through a concaved annular portion.

8. An engine valve lifter mechanism as claimed in claim 5, wherein the oil hole is placed nearer to the boss than the turn back portion.

9. An engine valve lifter mechanism as claimed in claim 8, wherein the oil hole is positioned just beside the boss so that a radially inside outlet end of the oil hole is merged with the outer surface of the boss.

10. An engine valve lifter mechanism as claimed in claim 5, wherein the inner surface of the head part and an inner surface of the valve lifter are integrally connected through a concaved annular portion.

11. An engine valve lifter mechanism as claimed in claim 4, wherein the inlet end part of the oil hole is chamfered with a conical surface.

12. An engine valve lifter mechanism as claimed in claim 4, wherein the inlet end part of the oil hole is chamfered with a concaved surface.

13. An engine valve lifter mechanism as claimed in claim 4, wherein the valve lifter is configured to rotate in a circumferential direction upon receiving a force produced when the rounded cam surface of the swing cam swings on the upper surface of the head part.

14. An engine valve lifter mechanism as claimed in claim 4, wherein the upper surface of the head part of the valve lifter is treated with an abrasion resistant layer.

* * * * *